US006210018B1

(12) United States Patent
Kassay et al.

(10) Patent No.: US 6,210,018 B1
(45) Date of Patent: Apr. 3, 2001

(54) ANGLED MOUNTING BRACKET FOR HIGH LUMEN OUTPUT FLUORESCENT LAMP DOWN LIGHT FIXTURE

(76) Inventors: Charles Kassay; Suzanne Kassay; J. Peter Kassay; Marc Kassay, all of 9 Long Hill Rd., Smithtown, NY (US) 11787

( * ) Notice: Subject to any disclaimer, the term of this patent is extended or adjusted under 35 U.S.C. 154(b) by 0 days.

(21) Appl. No.: 09/169,225

(22) Filed: Oct. 9, 1998

(51) Int. Cl.[7] ..... F21V 7/10

(52) U.S. Cl. ..... 362/216; 362/225; 362/252; 362/260

(58) Field of Search ..... 362/225, 223, 362/252, 260

(56) References Cited

U.S. PATENT DOCUMENTS 5,371,661 * 12/1994 Simpson ..... 362/220

5,988,829 * 11/1999 Holder ..... 362/217

* cited by examiner

*Primary Examiner*—Darren Schuberg
*Assistant Examiner*—Fayez Assaf
(74) *Attorney, Agent, or Firm*—Alfred M. Walker

(57) ABSTRACT

An alternative lighting system luminaire to conventional fluorescent light fixtures includes an angled mounting bracket with a plurality of fluorescent lamps to provide both greater illumination of a linearly extending visual display aisle. The obliquely placed lamps are secured and powered by sockets fastened to the angled mounting bracket which is mounted to the ballasts of the fixture. Ballasts are located in the area between the reflector and the top of the fixture. The light emitted ends of the fixture are angled downward to illuminate areas not immediately below the lighting fixture itself.

12 Claims, 3 Drawing Sheets

ANGLED MOUNTING BRACKET FOR HIGH LUMEN OUTPUT FLUORESCENT LAMP DOWN LIGHT FIXTURE

FIELD OF THE INVENTION

The present invention relates to an angled mounting bracket for lighting fixtures which more efficiently produces lumens for linearly extending display aisles in large volume lighting environments, such as retail food or department stores.

BACKGROUND OF THE INVENTION

There are many typical uses for fluorescent lighting fixtures, such as for retail stores, warehouses, commercial buildings and other uses possessing relatively high ceilings and linearly extending display aisles. Fluorescent lighting fixtures have been highly successful due to their linearly extending bulbs emitting an amount of output of light.

These linearly extending fluorescent lighting fixtures typically include one or more light source lamps with a solid reflector utilized to direct the light in a downward direction. This reflector is normally a concave half cylindrical shape. These prior art reflectors are made of reflective substances such as polished aluminum to enhance the efficiency of the fixture. The lamps supply direct light and light reflected off the reflector in a downward direction.

A great quantity of light is supplied by these prior art fluorescent fixtures directly to a display area below.

The drawbacks to using these linearly extending fluorescent light fixtures include the diminishing lumen output in the display areas not immediately below each linearly extending fluorescent light fixture. For example, while a four foot long fixture will efficiently light a display area below it, there is a greatly diminished lighting of the portion of the display areas not immediately below each fluorescent light fixture. In essence, the areas between the fluorescent light fixtures are in shadows.

Fluorescent lamped fixtures have typically utilized long longitudinally extending cylindrical lamps, which are mounted at or slightly below the ceiling level, parallel to the floor surface. These prior art fluorescent lamp fixtures are usually one (1) to four (4) tubes of four foot to eight foot lengths per fixture. The fluorescent lamped fixtures illuminate a rectangular area immediately below. The draw back with the prior art fluorescent fixtures is that in order to avoid the aforementioned shadow areas of diminished lighting, a large quantity closely placed of lamp fixtures is required, to minimize unlit display areas. The large quantities of fluorescent fixtures significantly increases the initial installation costs. Therefore, the traditional fluorescent lamp lacks the intensity needed for large spacing between lamps at high mounting levels.

OBJECTS OF THE INVENTION

To overcome the disadvantages and drawbacks of fluorescent lamp fixtures in display areas with long linearly extending display aisles, it is a desirable object of the present invention to produce a fixture producing high quantities of light thereat.

It is a further object of the present invention to produce a greater efficiency of light produced by the fixture itself.

It is yet another object of the present invention to provide an efficient structural configuration for the mounting of a fluorescent lamp fixture which maximizes lumen output to linearly extending display aisles in large volume areas.

To improve over the disadvantages of the prior art, it is another object of the present invention to create a superior mounting bracket for lighting fixtures.

It is yet another object of the present invention to prevent darkened shadow areas in areas between the direct light output of downward facing fluorescent light fixtures.

It is yet another object of the present invention to improve over the disadvantages of the prior art.

SUMMARY OF THE INVENTION

In keeping with these objects and others which will become apparent, the present invention includes a mounting bracket for a fluorescent lighting fixture which contains a reflector and/or a refractor, and a plurality of linearly extending fluorescent lamps. The present invention includes an angled mounting bracket for a fluorescent light fixture with a plurality of configuration sockets, a socket plate or set of plates holding the sockets, a ballast enclosure or cavity housing holding one or more ballasts, wherein the linearly extending reflector or reflectors are provided at an oblique angle with respect to a horizontal plane,and which housing has an ability to receive a bottom light transmitting lens.

The shape of the housing of the present invention is V-shaped for mounting of the fluorescent lamps obliquely, so that emitted light will be angled downward to illuminate the area immediately below the lighting fixture as well as the normally darkened shadow area not immediately below the lighting fixture.

One or more linearly extending fluorescent lamps are provided within each angled mounted fixture.

The fluorescent lamps receive their power from ballasts mounted in the ballast cavity, which is above each reflector in the angled fixture. The angle for each fixture is from five (5) degrees to thirty five (35) degrees off of horizontal, preferably at about twenty two and one half (22.5) degrees off of horizontal.

The angled mounting bracket of the lighting fixture of the present invention illuminates a wide area, and includes: at least one housing, at least one source of light, a plurality of lamp sockets, and at least one reflector; wherein the housing includes a plurality of adjacent, angularly divided segments. The segments each have at least one lamp socket and at least one reflector for reflecting lamp illumination.

The adjacent angularly divided segments are disposed at an angle relative to a horizontal plane of from about 5 degrees to about 35 degrees of arc, preferably by about 22.5 degrees.

The fixture is an electrical fixture having at least one component box for electrical components, such as a fluorescent lamp fixture having sockets for at least one fluorescent lamp disposed on each angularly divided segment. The angularly divided segments may include a substantially flat surface, wherein the fluorescent lamps are straight fluorescent lamps.

The fluorescent lamps may also be curved fluorescent lamps.

Each fixture includes the sockets for the fluorescent lamps with electrical contacts with a threaded base aperture contact and a central base contact, wherein the threaded aperture and central contacts are electrically insulated from each other. The contacts accept the fluorescent lamps.

The adjacent angularly divided segments may contact each other at an angular segment joint, wherein the joint comprises the joining line between the adjacent segments and which embodies the angle between adjacent segments.

The straight fluorescent lamps are mounted parallel to the substantially flat surface, and the straight fluorescent lamps are disposed so that the longitudinal axis of the straight lamp is in perpendicular relation to the angular segment joint.

Optionally, the straight fluorescent lamps may be disposed so that the longitudinal axis of the straight lamp is in parallel relation to the angular segment joint, or wherein the straight fluorescent lamps are disposed so that the longitudinal axis of the straight lamp is in radial relation to the angular segment joint.

The housing may have at least one lens between the source of light and the area to be illuminated, wherein the lens angularly disperses lamp illumination into the area to be illuminated, including the areas directly below the lighting fixture, as well as the areas adjacent to the area directly below the lighting fixture.

DESCRIPTION OF THE DRAWINGS

The present invention can best be understood in connection with the accompanying drawings, in which.

DETAILED DESCRIPTION OF THE DRAWINGS

Figure 1:
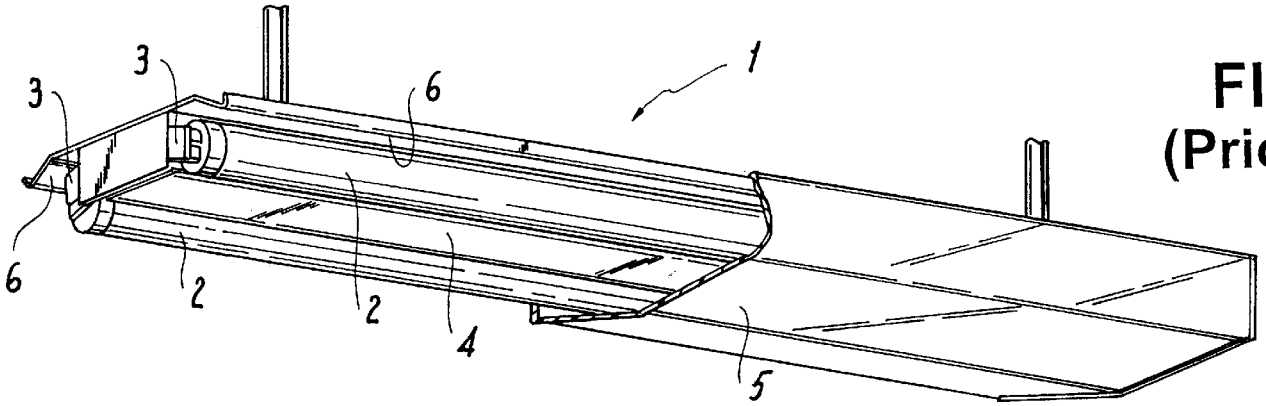
FIG. 1 (Prior Art)
FIG. 1 is a prior art perspective view of a suspended fluorescent light fixture.

Referring to FIG. 1, designated "Prior Art", there is a shown side elevational diagram of a typical horizontally mounted fluorescent lighting fixture. Fluorescent fixtures (1) have linearly extending cylindrical lamps (2) clipped into electrical sockets (3) to receive electrical power from ballast (4), to obtain increased voltages to energize the gases in each respective fluorescent lamp (2). The light produced by these prior art fixtures (1) is emitted in a vertically downward direction out an open light emitting end through lens (5). The light generated is only emitted directly below the fixture, as it is not reflected angularly, because of vertical orientation of the emitted light from the horizontally placed lamps (2).

Referring to FIG. 1, these prior art fluorescent fixtures are enhanced by the use of reflectors (6) to increase the amount of light emitted.

Figure 2:
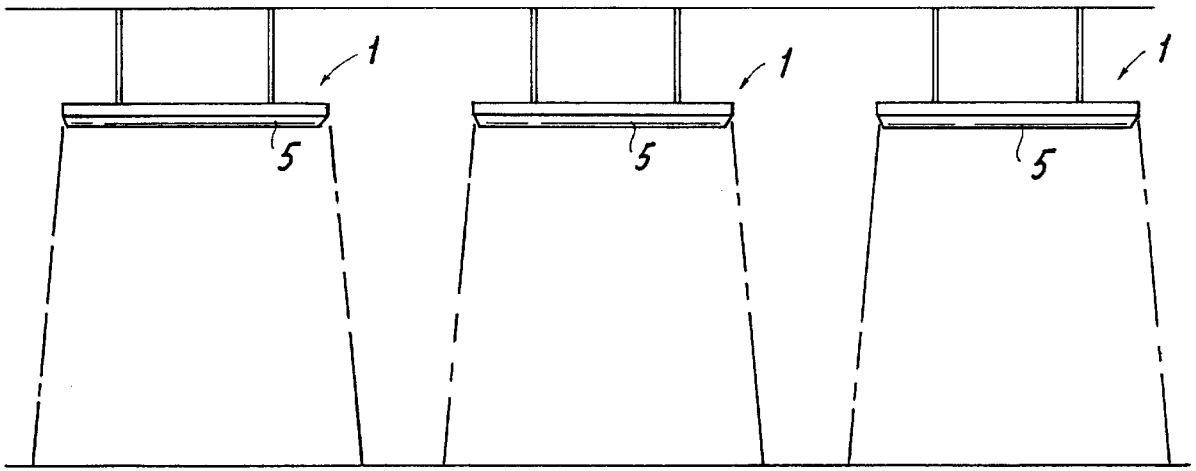
FIG. 2 (Prior Art)
FIG. 2 is a diagrammatic side elevational view of an installed prior art fixture as in FIG. 1, illustrating the down light dispersion therefrom.

As shown in FIG. 2, these prior art fluorescent fixtures of FIGS. 1 and 2 are used in commercial buildings, retail applications and other locations having long, linearly extending display aisles and relatively low ceilings, which require that they be installed closely together. A chief disadvantage of these prior art fluorescent fixtures is that they do not reflect light in areas not immediately below each fixture, thereby creating darkened shadowed zones of diminished visibility.

Figure 3:
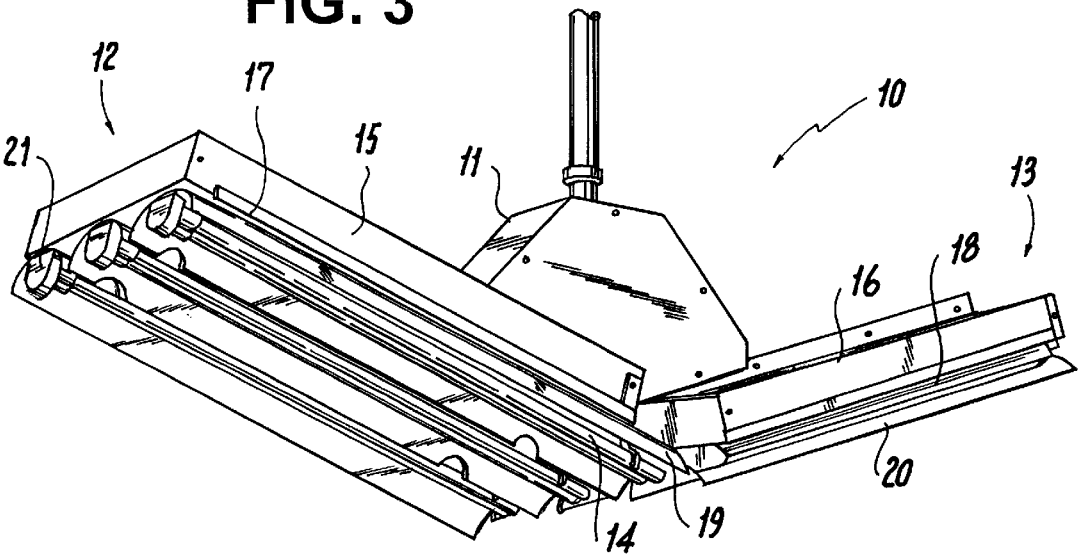
FIG. 3 is underside perspective view of a preferred embodiment for an angled bracket for mounting fluorescent fixtures to achieve broader light dispersion.
Figure 4:
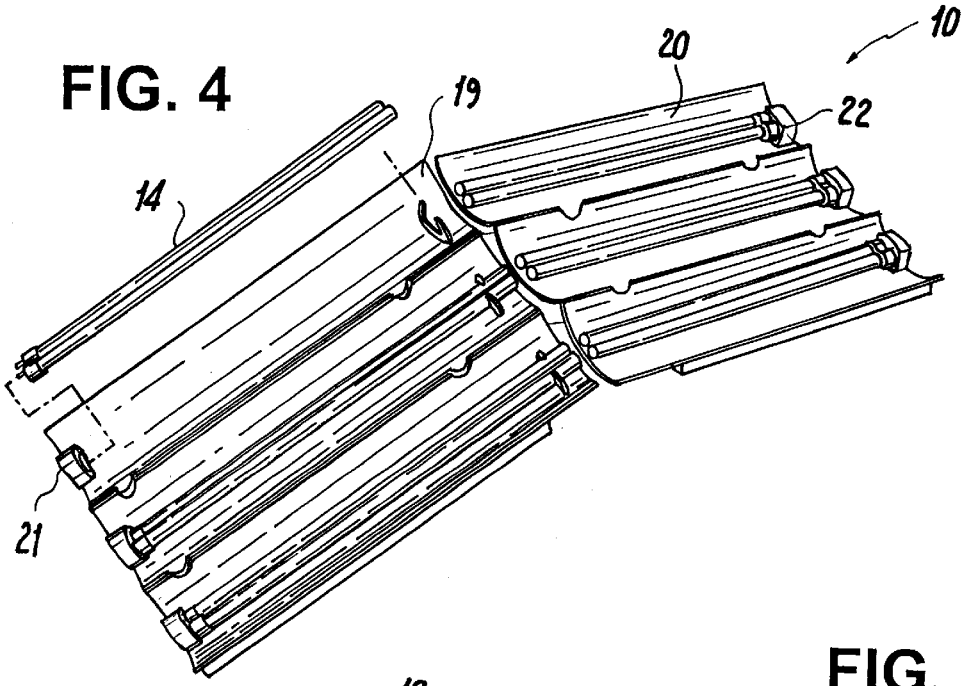
FIG. 4 is an exploded inverted perspective view of the angled bracket with the fluorescent fixtures shown exploded away therefrom.
Figure 5:
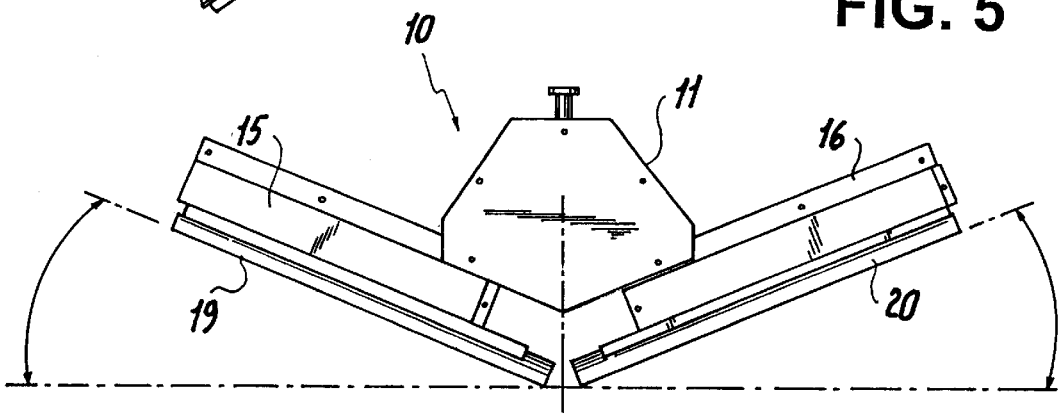
FIG. 5 is a side elevational view in partial cutaway of the angled mounting bracket as in FIG. 3.

In contrast to the prior art light devices, the present invention is described in FIGS. 3, 4 and 5, which show perspective and a side elevational views of the new configuration for fluorescent lighting fixtures of the present invention, which includes a lighting fixture (10) having an angled mounting bracket (11) for fixtures (12), (13) having one or more linearly extending lamps (14). Mounting bracket (11) has a configuration of a pair of obliquely placed housings (15), (16) holding fixtures (12), (13) at an angle relative to a horizontal plane, such as from five (5°) degrees to thirty five (35°) degrees. Angled mounting bracket (11) is suspended and is hung from a ceiling.

When viewed from the bottom, into its respective light emitting end, each housing (15), (16) may be rectangular in shape, having typical dimensions of four feet by four inches.

Figure 6:
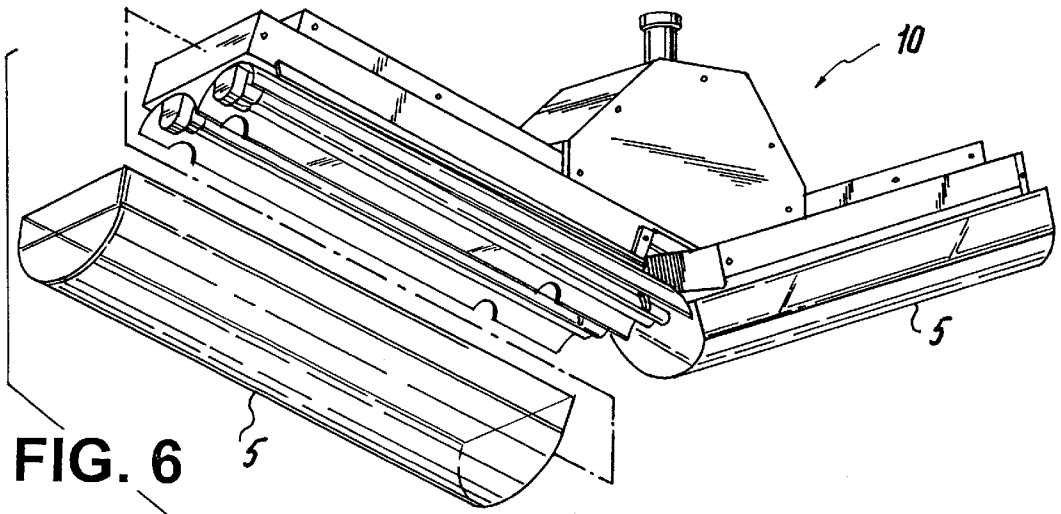
FIG. 6 is an underside perspective view of an alternate embodiment for an angled mounting bracket of the present invention, shown with a pair of lamps on each side; and, FIG. 7 is a diagrammatic side elevational view of installed light fixtures attached to the angle mounting bracket of the present invention, illustrating the down light dispersion therefrom.

Each housing (15), (16) encloses ballasts (17), (18), which ballasts (17), (18) contains a single ballast or multiple ballasts. Ballasts (17), (18) power either one, two or three fluorescent lamps per ballast. For example, FIGS. 3, 4 and 5 show three fluorescent lamps per ballast and FIG. 6 shows two fluorescent lamps per ballast. FIG. 6 also shows optional lens 5. Ballasts (17), (18) receive their power through an electrical connection entering through housings (15), (16). Lighting fixture (10) of the present invention can also be directly wired with no cord end. Below ballasts (17), (18) may be reflectors (19), (20) which are used to maximize the efficiency of fluorescent lamps (14) in fixture (10) and to direct the light downward through optional lens (21), (22). Reflectors (19), (20) are attached and supported to angled mounting bracket (11), to which sockets (21), (22) are fastened. Sockets (21), (22) are designed to receive linearly extending fluorescent lamps (14).

Lamps (14) are placed parallel to each other and parallel to each obliquely placed housings (15), (16) of fixture (10), so that the maximum light can be reflected down at an angle from reflectors (19), (20).

Figure 7:
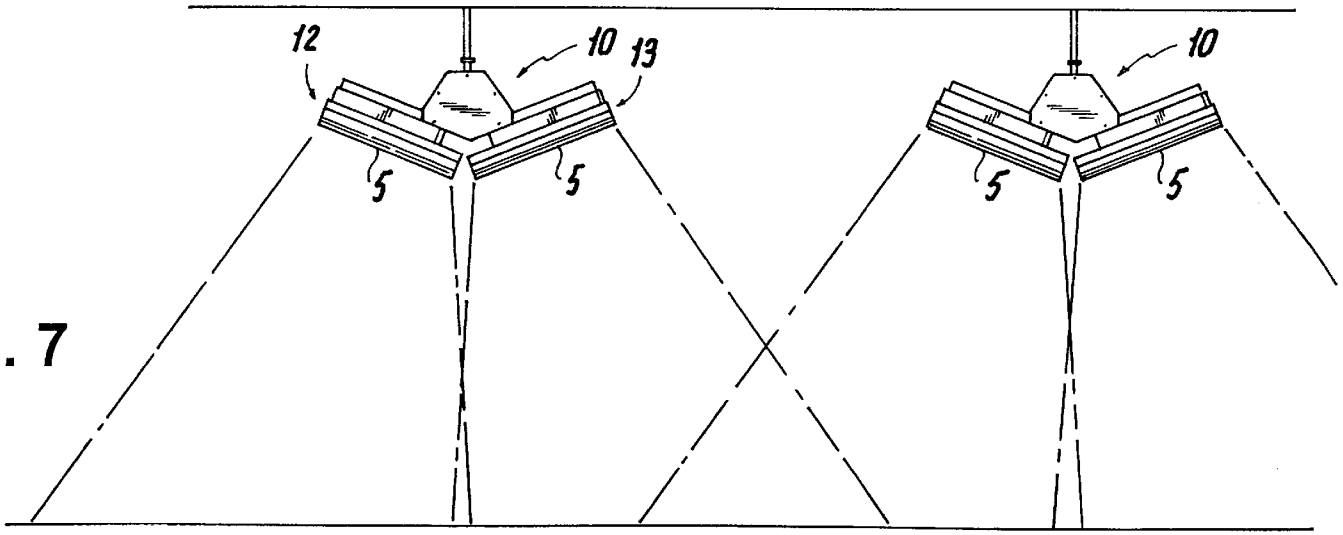

The light created by these lamps (14) is then reflected obliquely down thereby lighting both the area immediately below each fixture (10) as well as the areas not having a fixture directly above. As shown in FIG. 7, an entire linearly extending aisle is lit, because adjacent obliquely reflected light paths intersect to cover all areas not having a light fixture (10) directly above.

The advantages over the prior art of FIGS. 1, and 2 is that due to its shape, mounting bracket (11) of fixture (10) has the ability to reflect all areas of a linearly extending display aisle without darkened shadows. Additionally, a far greater coverage of light is available from this design due to the angled displacement of lamps (14) which enables fixture (10) to illuminate beyond the area immediately below.

The advantage of this fixture over the prior art is that the horizontally oriented fixtures therein create dark shadows, because the light emitted in the upward direction is not reflected obliquely. The present invention produces a greater amount of light and directs light obliquely in a downward direction.

There will be many variations in the construction, which should remain within the intent coverage of the present invention. Some of the variations could use different ballasts, different quantities of lamps per ballast, different quantities of lamps, changes in the reflector and/or configuration, changes in the individual lamp wattage's, use of different lens in front, and different overall sizes to accommodate the preceding goals.

It is further noted that other modifications may be made to the present invention without departing from the scope of present invention as noted in the appended claims.

We claim:

1. A lighting fixture for illuminating a wide area, comprising: at least one housing, at least one source of light, a plurality of lamp sockets, at least one reflector; wherein further the at least one housing is comprised of a plurality of adjacent, angularly divided segments, the segments each having at least one lamp socket and at least one reflector for reflecting lamp illumination, said lighting fixture further having fluorescent lamps, wherein further the adjacent angularly divided segments contact each other at an angular segment joint, wherein the joint comprises the joining line between the adjacent segments and which embodies the angle between adjacent segments, and further wherein, said fluorescent lamps are mounted parallel to a longitudinally extending substantially flat surface of each said angularly divided segment; and, said fluorescent lamps are disposed so that a longitudinal axis of each said lamp is in perpendicular relation to the angular segment joint.

2. The device of claim 1 wherein further, said adjacent angularly divided segments are disposed at an angle relative to a horizontal plane of from about 5 degrees to about 35 degrees of arc.

3. The device of claim 2 wherein the angle relative to the horizontal is about 22.5 degrees.

4. The device of claim 1 wherein said fixture is an electrical fixture having at least one component box for electrical components.

5. The device of claim 4 wherein said fixture is a fluorescent lamp fixture having sockets for at least one fluorescent lamp disposed on each said angularly divided segment.

6. The device of claim 5 wherein said angularly divided segments each include a substantially flat surface.

7. The device of claim 5 wherein the angularly divided segments each include at least one concave semi cylindrical reflector for each fluorescent lamp.

8. The device of claim 1 wherein the fluorescent lamps comprise straight fluorescent lamps.

9. The device of claim 1 wherein the fluorescent lamps comprise curved fluorescent lamps.

10. The device of claim 1 wherein said sockets for said fluorescent lamps each have respective electrical contacts, said electrical contacts comprising a threaded base aperture contact and a central base contact, wherein said threaded base aperture contact and said central contact are electrically insulated from each other, said contacts accepting said fluorescent lamps therein.

11. The device of claim 1, wherein further said housing includes at least one lens between the source of light and the area to be illuminated.

12. The device of claim 11 wherein the at least one lens disperses lamp illumination into the area to be illuminated.

* * * * *